United States Patent [19]

Task

[11] Patent Number: 4,867,331

[45] Date of Patent: Sep. 19, 1989

[54] COMBINATION HORS D'OEURVES, DRINK AND UTENSIL HOLDER

[76] Inventor: Harry L. Task, 5513 Snowbank Cir., Dayton, Ohio 45431

[21] Appl. No.: 346,273

[22] Filed: Apr. 28, 1989

Related U.S. Application Data

[63] Continuation of Ser. No. 84,919, Aug. 13, 1987, abandoned.

[51] Int. Cl.[4] ..... B65D 1/36

[52] U.S. Cl. ..... 220/23.8; 206/558; 206/564; 220/23.83; D7/38

[58] Field of Search ..... 220/23.83, 23.86, 23.4, 220/23.8; 206/562–564, 557, 558, 503, 507; D7/38, 70

[56] References Cited

U.S. PATENT DOCUMENTS

| | | | |
|---|---|---|---|
| D. 130,770 | 12/1941 | Morgan | D7/38 X |
| D. 159,454 | 7/1950 | Waltman | D7/38 |
| D. 185,911 | 8/1959 | Chadbourne | D7/38 X |
| D. 195,527 | 6/1963 | Gilbert | 206/564 X |
| D. 214,459 | 6/1969 | Stageberg | 220/23.83 X |
| D. 221,035 | 6/1971 | Raines | 206/564 X |
| D. 226,125 | 1/1973 | Robinson | D7/38 |
| D. 265,154 | 6/1982 | Cox | D7/38 X |
| D. 293,767 | 1/1988 | Powers | D7/38 X |
| 2,700,284 | 1/1955 | Lyon, Jr. | 220/23.8 |
| 3,121,507 | 2/1964 | Weiss | 220/23.8 |
| 3,122,265 | 2/1964 | Innis | 206/564 X |
| 3,942,671 | 3/1976 | Florian | 220/23.8 |
| 3,955,672 | 5/1976 | Brundage | 206/562 |
| 4,823,958 | 4/1989 | Mahmud | 206/564 X |

FOREIGN PATENT DOCUMENTS

| | | | |
|---|---|---|---|
| 723008 | 12/1965 | Canada | 206/507 |
| 2078095 | 1/1982 | United Kingdom | D7/38 |

*Primary Examiner*—Bryon P. Gehman
*Attorney, Agent, or Firm*—John R. Flanagan

[57] ABSTRACT

A holder for food, drink and utensils includes a flat oval-shaped platform having a central food supporting portion and an upturned peripheral retaining lip, and a pair of cup-shaped recessed compartments connected to and extending below the platform. The compartments are spaced from one another at opposite ends of the platform. One recessed compartment is a beverage container compartment and the other is a utensil compartment. A third recessed compartment can be provided as an option to hold a party dip. The container compartment is larger in diameter than the utensil compartment. The dip compartment is preferably oblong in shape and of a shallower depth than the other two which are equal in depth. The container and utensil compartments make the holder capable of standing by itself in an upright fashion. Further, the two compartments are spaced apart sufficiently to allow insertion of a person's hand between them and then cupping of the hand for gripping the exterior of the container compartment to hold and position the holder with the central platform portion resting on top of the cupped hand and the exterior of the utensil compartment contacting the back of the cupped hand. Also, the compartments each have a tapered configuration which allows stacking of holders with their corresponding compartments in nested relationship with one another.

6 Claims, 1 Drawing Sheet

COMBINATION HORS D'OEURVES, DRINK AND UTENSIL HOLDER

This application is a continuation of application Ser. No. 07/084,919, filed Aug. 13, 1987.

BACKGROUND OF THE INVENTION

1. Field of the Invention

The present invention generally relates to the serving of food and drink at parties and gatherings and, more particularly, is concerned with a combination holder for food, drink and utensils which is easily held in a person's hand and is freestanding when set down on a support surface.

2. Description of the Prior Art

The serving of refreshments to guests at cocktail parties, receptions, and similar gatherings has long presented problems with respect to how a guest is to hold the hor d'oeuvres, drink and utensils, such as a toothpick, stirrer or fork. Ordinarily, the guest has to hold a beverage container in one hand and a small plate with hors d'oeuvres in the other and rest the utensils on the edge of the plate. This is both awkward and inconvenient, and subjects guests to the embarrassment of accidental spills. Whenever the guest wants to take a bite of hors d'oeuvres, he or she must first set down the beverage container. Also, either the container or plate must be set down whenever guests wish to greet or say goodbye to each other by shaking hands.

Many devices have been proposed in the prior art to make the serving and holding of food and drinks easier. Representative of the prior art are the devices disclosed in U.S. Patents to White et al (U.S. Pat. No. 3,401,858), Dyer et al (U.S. Pat. No. Des. 165,640), Nowland et al (U.S. Pat. Des. No. 227,851), Graham (U.S. Pat. Des. No. 194,114), Warren (U.S. Pat. Des. No. 186,391), Sabol (U.S. Pat. No. 3,162,344), Alexander (U.S. Pat. Des. No. 235,500), Zorn (U.S. Pat. Des. No. 201,696), Jacobsen (U.S. Pat. Des. No. 148,419), Berry (U.S. Pat. Des. No. 182,396), Jaskulek et al (U.S. Pat. Des. No. 206,390), McCaig (U.S. Pat. Des. No. 182,243), Schneider et al (U.S. Pat. No. 3,792,809), Oliver (U.S. Pat. No. 2,295,860) and Porter (U.S. Pat. Des. No. 87,682). While all of these prior art devices may function reasonably well under the limited range of conditions for which they were designed, each device appears to embody one or more drawbacks which makes it less than an optimum solution to the above-described problems. Many of the devices do not adequately support the beverage container to prevent it from sliding about or tipping over and spilling if the hand of the person holding the device moves abruptly or is bumped. Most of the devices are not designed to be compatible with the natural gripping position of a person's hand in holding objects. At least one of the devices is not capable of standing upright by itself when placed on a support surface. Many of the devices cannot be set down on or picked up from a support surface without first having to tilt the device to release or grip it thereby requiring both of the user's hands to steady the objects on the device to prevent them from tipping over or sliding off the device.

Consequently, in view of the above-described problems and drawbacks, it is readily apparent that a need exists for a food, drink and utensil holding device which takes a human factors approach in its design and protects the objects resting thereon from accidental tipping and spilling.

SUMMARY OF THE INVENTION

The present invention provides a combination food, drink and utensil holder designed to satisfy the aforementioned needs. The holder of the present invention eliminates the above-described problems and shortcomings by providing a device that will stand upright on a support surface by itself without tipping over, can be set down on or picked up from the support surface without first tilting it, protects the objects resting thereon from accidentally tipping over or spilling, and accommodates being held in the way a person's hand naturally grips an object.

Accordingly, the present invention is directed to a holder for food, drink and utensils, comprising in combination: (a) a generally flat platform having a generally centrally-located food supporting portion; and (b) a pair of cup-shaped recessed compartments connected to and extending below the platform and opening from above the platform. The compartments are laterally spaced from one another and disposed at opposite ends of the food supporting portion of the platform. One of the compartments is a beverage container compartment and the other is a utensil compartment. The beverage container compartment is larger in diameter than the utensil compartment, but both compartments in conjunction with their spaced apart relation and respective diameters are adapted to make the holder capable of standing by itself in an upright fashion on a support surface with the platform of the holder disposed in a plane capable of supporting food on the central portion thereof.

More particularly, the two compartments are spaced apart sufficiently to allow insertion of a person's hand between them and then cupping of the hand for gripping the exterior of the beverage container compartment to hold and position the holder with the central portion of the platform resting on top of the cupped hand and the exterior of the utensil compartment contacting the back of the cupped hand. Still further, both of the compartments have respective flat bottoms. The respective compartment bottoms are closed. Both of the compartments are substantially the same in depth. The platform has an upwardly projecting peripheral retaining lip, whereas each of the compartments has a rim which projects upward above the platform.

Also, as an option, the holder can include a third recessed compartment connected to and extending below the platform and opening from above the platform. The third compartment, for example used for party dip, is disposed between the spaced pair of compartments and offset to one side of the central platform portion. Preferably, the third compartment is shallower in depth than either one of the compartments of the pair thereof.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED

Figure 1:
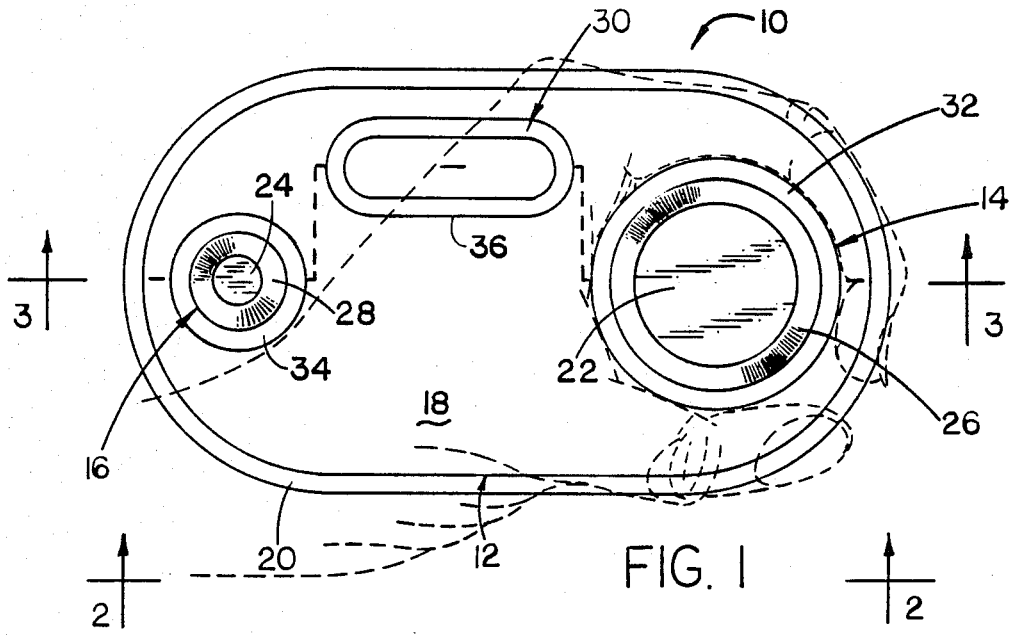
FIG. 1 is a top plan view of a combination food, drink and utensil holder of the present invention, illustrating a person's hand gripping and supporting the holder.
Figure 2:
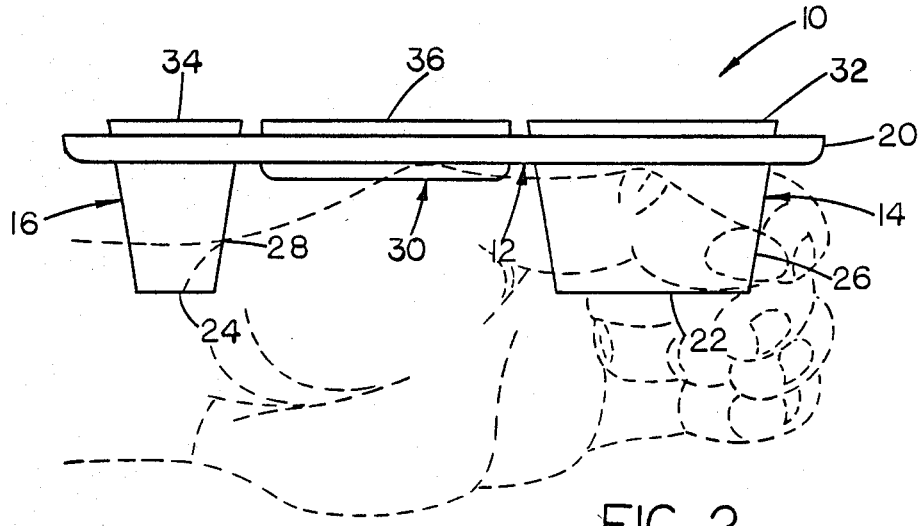
FIG. 2 is a side elevational view of the holder and the person's hand as seen along line 2—2 of FIG. 1.
Figure 3:
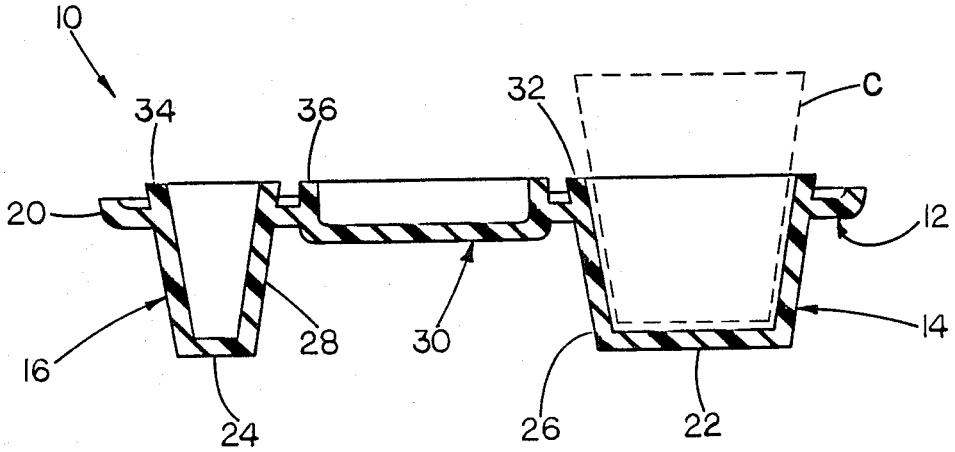
FIG. 3 is a cross-sectional view of the holder taken along line 3—3 of FIG. 1.

Referring now to the drawings, and particularly to FIGS. 1 and 2, there is shown a combination food, drink and utensil holder, generally designated by the numeral 10 and being constructed in accordance with the principles of the present invention. In its basic components, the combination holder 10 includes a generally flat oval-shaped platform 12 and a pair of cup-shaped recessed compartments 14,16. The platform 12 has a generally centrally-located portion 18 for holding food, such as hors d'oeuvres, and an upwardly projecting peripheral retaining lip 20. The pair of recessed compartments 14,16 are connected to and extend below the platform 12 and open from above the platform.

More particularly, the compartments 14,16 are laterally spaced from one another and disposed at opposite ends of the food support-portion 18 of the platform 12. The one compartment 14 is a beverage container compartment, whereas the other compartment 16 is a utensil compartment. The beverage container compartment 14 is larger in diameter than the utensil compartment 16. Both compartments 14,16 have flat closed bottoms 22,24 and tapered sidewalls 26,28, and are substantially the same in depth. Due to their flat bottoms 22,24, their spaced apart relation and their respective diameters, the container and utensil compartments 14,16 make the holder 10 capable of standing by itself in an upright fashion on a support surface, such as a table, with the platform 12 of the holder 10 being disposed in a generally horizontal plane in which it is capable of supporting food on the central portion 18 thereof located between the compartments 14,16.

The holder 12 is designed with a human factors approach. In particular, the two compartments 14,16 are spaced apart sufficiently to define a cavity 17 therebetween being sized for insertion of a typical person's hand H between the compartments 14,16 and into the cavity 17. The width of the hand-insertion cavity 17 permits cupping of the hand H for gripping the exterior of beverage container compartment 14 to hold and position the 10 holder with the central portion 18 of the platform 12 resting on top of the cupped hand and the exterior of the utensil compartment 16 contacting the back of the cupped hand. In FIGS. 1 and 2, it can be seen that the hand insertion cavity 17 defined between the compartments 14,16 is of a width generally equal to the size of the person's single or one cupped hand H as measured from the inside to the back thereof.

Optionally, a third recessed compartment 30 can be provided for holding condiments, such as party dip, tartar sauce or shrimp cocktail sauce. The third compartment 30 is connected to and extends below the platform 12 and opens from above the platform. The third compartment 30 is disposed between the spaced pair of container and utensil compartments 14,16 and offset to one side of the central platform portion 18. The third compartment 30 can be shallower in depth than either one of the container and utensil compartments 14,16. The compartments 14,16,30 have respective rims 32,34,36 which projects upward above the platform 12.

By way of example, the container and utensil compartments 14,16 of the holder 10 are of the same depth, within the range of approximately 1 to 2 inches. Approximately the lower half to two-thirds of a typical beverage container C, being shown in dashed line form in FIG. 2, will seat in the compartment 14. The compartment 16 is sized to hold thin utensils such as toothpicks, stirrers or a fork. The container compartment 14 is approximately $2\frac{1}{4}$ to $3\frac{1}{4}$ inches in diameter. The utensil compartment 16 is approximately $\frac{3}{4}$ to $1\frac{1}{2}$ inches in diameter. The compartments 14,16 which define the hand-insertion cavity 17 therebetween are spaced apart approximately 3 to 5 inches. Thus the pair of compartments 14,16 are laterally spaced apart within the range of approximately $1\frac{1}{2}$ to 2 times the diameter of the beverage container compartment 14 so that the cavity extending therebetween can only accommodate insertion of the person's one cupped hand for gripping the exterior of the beverage container compartment from between the compartments. As described above, the sidewalls 26,28 of the compartments 14,16 each have a tapered configuration which allows stacking of multiple holders with their corresponding compartments in nested relationship with respect to one another to allow minimum space packaging. The third compartment 30 is approximately $\frac{1}{4}$ to $\frac{1}{2}$ inch in depth.

The holder 10 can be a disposable one-piece plastic version made using plastic injection molding techniques. Alternatively, a sturdier longer lasting material can be used which will allow washing and reuse of the holder.

In conclusion, it is readily seen that the combination holder 10 of the present invention can be held easily in one hand by being gripped the same as a beverage container is gripped. It solves the problem of trying to eat while holding a drink in one hand and a plate of hors d'oeuvres in the other. Since both the drink, utensils and hors d'oeuvres can be conveniently held with one hand by using this device, it is also possible to free the other hand for meeting people by shaking hands. Furthermore, the particular design of the holder would allow either right-handed or left-handed use since it is bi-axially symmetric.

It is thought that the combination holder of the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A single-hand supported holder for food, drink and utensils, comprising in combination:

(a) a generally flat platform having a generally centrally-located food supporting portion and an upwardly projecting peripheral retaining lip; and (b) a pair of cup-shaped recessed compartments connected to and extending below said platforms and opening from above said platform, said compartments being laterally spaced from one another and disposed at opposite ends of said food supporting portion of said platform;

(c) one of said compartments being a beverage container compartment of approximately $2\frac{1}{4}$ to $3\frac{1}{4}$ inches in diameter and the other of said compartments being a utensil compartment, said beverage container compartment being larger in diameter than said utensil compartment;

(d) both of said compartments having flat closed bottoms and being substantially the same in depth, solely said pair of compartments in conjunction with their spaced apart relation, same depth, flat bottoms and respective diameters adapting said holder to stand in an upright fashion on a horizontal support surface with said platforms thereof in a generally horizontal plane in which it is capable of supporting food on said central portion thereof;

(e) said pair of compartments being laterally spaced apart approximately 3 to 5 inches to define a cavity extending therebetween of a width within the range of approximately 1½ to 2 times the diameter of said beverage container compartment so that said cavity can only accommodate insertion of a person's single cupped hand for gripping the exterior of said beverage container compartment from between said compartments to hold and position said holder with said central portion of said platform resting on top of the cupped hand and the exterior of said utensil compartment contacting the back of the cupped hand.

2. The holder as recited in claim 1, further comprising:

a third recessed compartment connected to and extending below said platform and opening from above said platform, said third compartment being disposed between said spaced pair of compartments and offset to one side of said central platform portion and of said cavity defined between said spaced pair of compartments, said third compartment being shallower in depth than said compartments of said pair thereof.

3. The holder as recited in claim 1, wherein said compartments are both approximately 1 to 2 inches in depth.

4. The holder as recited in claim 1, wherein said utensil compartment defining said cavity therebetween is approximately ¾ to 1½ inches in diameter.

5. The holder as recited in claim 1, wherein said compartments each have a tapered configuration which allows stacking of said holders with their corresponding compartments in nested relationship with respect to one another.

6. The holder as recited in claim 1, wherein each of said compartments has a rim which projects upward above said platform.

* * * * *